US006276339B1

(12) United States Patent
Shebert, Jr. et al.

(10) Patent No.: US 6,276,339 B1
(45) Date of Patent: Aug. 21, 2001

(54) FUEL INJECTOR SPRING CLIP ASSEMBLY

(75) Inventors: Leonard Lee Shebert, Jr., Pittsford; Jared Ivan Meeker, Rochester, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/563,632

(22) Filed: May 2, 2000

(51) Int. Cl.[7] ..... F02M 37/04
(52) U.S. Cl. ..... 123/470
(58) Field of Search ..... 123/468, 469, 123/470, 456

(56) References Cited

U.S. PATENT DOCUMENTS 4,984,548 * 1/1991 Hudson, Jr. ..... 123/470
5,035,224 * 7/1991 Hornby ..... 123/470
5,040,512 * 8/1991 Twilton ..... 123/470
5,074,269 * 12/1991 Herbon et al. ..... 123/470
5,501,195 * 3/1996 Hall ..... 123/470
5,803,052 * 9/1998 Lorraine et al. ..... 123/470
6,019,089 * 2/2000 Taylor et al. ..... 123/470
6,053,149 * 4/2000 Lorraine ..... 123/470

* cited by examiner

*Primary Examiner*—Thomas N. Moulis
(74) *Attorney, Agent, or Firm*—John A. Vanophem

(57) ABSTRACT

A spring clip assembly for connecting a fuel injector to a fuel rail in an internal combustion engine comprises a substantially circular ring having a circumferential outer surface, to which are attached a first and a second plurality of elongate fingers. The first plurality of elongate fingers extends in a first direction parallel to the axis of the ring and includes connecting means for attaching the ring to a fuel injector. The second plurality of elongate fingers extends in a second, opposite axial direction and includes connecting means for attaching the ring to the fuel rail. The spring clip assembly further comprises spring means held proximate a surface of the ring by either the first plurality or the second plurality of elongate fingers. The spring means provides a compressive load between the fuel injector and the fuel rail. A fuel rail-injector assembly comprises a fuel rail, a plurality of fuel injectors, and a corresponding plurality of the just-described spring clip assemblies for connecting the injectors to the rail.

21 Claims, 3 Drawing Sheets

FUEL INJECTOR SPRING CLIP ASSEMBLY

TECHNICAL FIELD

The present invention generally relates to fuel injector and, more particularly, to a spring clip assembly for connecting a fuel rail to a fuel injector mounted in the cylinder head of an internal combustion engine.

BACKGROUND OF THE INVENTION

The use of spring clips as a connecting member to urge the fuel injector toward its sealing surface after assembly is standard practice in a multi-port fuel injection (MPFI) system. However, conventional MPFI spring clips are not suitable for use in high pressure direct injector (DI) applications in which a DI fuel injector is mounted in the engine cylinder head directly above the combustion chamber since the nozzle end of the DI injector is directly exposed to the high combustion pressures which occur in the combustion chamber. In the case of a DI injector, a higher, positive load must be applied to the injector to hold it in place against the higher pressures and to ensure that it remains sealed against leakage of exhaust gases from the combustion chamber. In a high pressure DI system, each injector is typically individually mounted on the cylinder head by means of a clamp or a tab. This procedure of individually mounting each fuel injector adds substantially to the manual labor cost of the assembly of the engine.

U.S. Pat. No. 5,970,953, the disclosure of which is incorporated herein by reference, describes a fuel injector clip that is intended for high pressure applications. The clip disclosed in the '953 reference is disclosed as being compressed beyond its maximum yield point when the injector is installed. Therefore the maximum force the spring can exert to assure that the injector remains seated is limited and may not be suitable in a DI injector application. Copending, commonly assigned application Ser. No. 09/329,508, filed Jun. 10, 1999, for INTEGRATED FUEL DELIVERY MODULE FOR DIRECT INJECTION, the disclosure of which is incorporated herein by reference, discloses a spring more suitable for a DI injector application. The application discloses a module type fuel delivery system for direct fuel injection into the combustion chambers of multiple cylinders of an engine that includes a common fuel rail and a plurality of spaced fuel feeder passages extending from the fuel rail. Each feeder passage is provided with an open ended mounting recess for receiving a DI fuel injector. Between the mounting recess and the injector is positioned a spring for loading the injector against its seat in the cylinder head above the combustion chamber. The spring load seats the injector against the force of combustion pressure during engine operation.

While the module type fuel delivery system disclosed in application Ser. No. 09/329,508 does not require that each injector be individually mounted to the cylinder head first, the labor time associated with hand assembling each spring between the recess of the feeder passage and the injector immediately before the module is installed on the engine can be substantial. Moreover, assembling the individual injectors to the fuel rail immediately before engine installation does not lend itself to an easy way of testing for flow and leakage of the fuel rail/injectors module before the module is installed on the engine.

Therefore, there is an ongoing need for a device that allows high pressure fuel injectors to be conveniently preassembled with a fuel rail prior to its connection to an engine cylinder head. The present invention addresses this need.

SUMMARY OF THE INVENTION

The present invention is directed to a spring clip assembly for connecting a fuel rail to a fuel injector in an internal combustion engine. The assembly comprises a substantially circular ring having a circumferential outer surface, to which are attached a first and a second plurality of elongate fingers. The first plurality of elongate fingers extend in a first direction with respect to the ring and include connecting means for attaching the ring to a fuel injector. The second plurality of elongate fingers extend in a second, direction and include connecting means for attaching the ring to a fuel rail. The spring clip assembly further comprises spring means held proximate a surface of the ring by either the first plurality or the second plurality of elongate fingers. The spring means provides a compressive load between the fuel injector and the fuel rail when the fuel rail-injector assembly is installed on the cylinder head.

Further in accordance with the present invention is a fuel rail-injector assembly that comprises a fuel rail, a plurality of fuel injectors, and a corresponding plurality of spring clip assemblies of the present invention for connecting the injectors to the rail that can be preassembled and tested as a module before being assembled to the cylinder head.

DESCRIPTION OF THE PREFERRED EMBODIMENT

Figure 1:
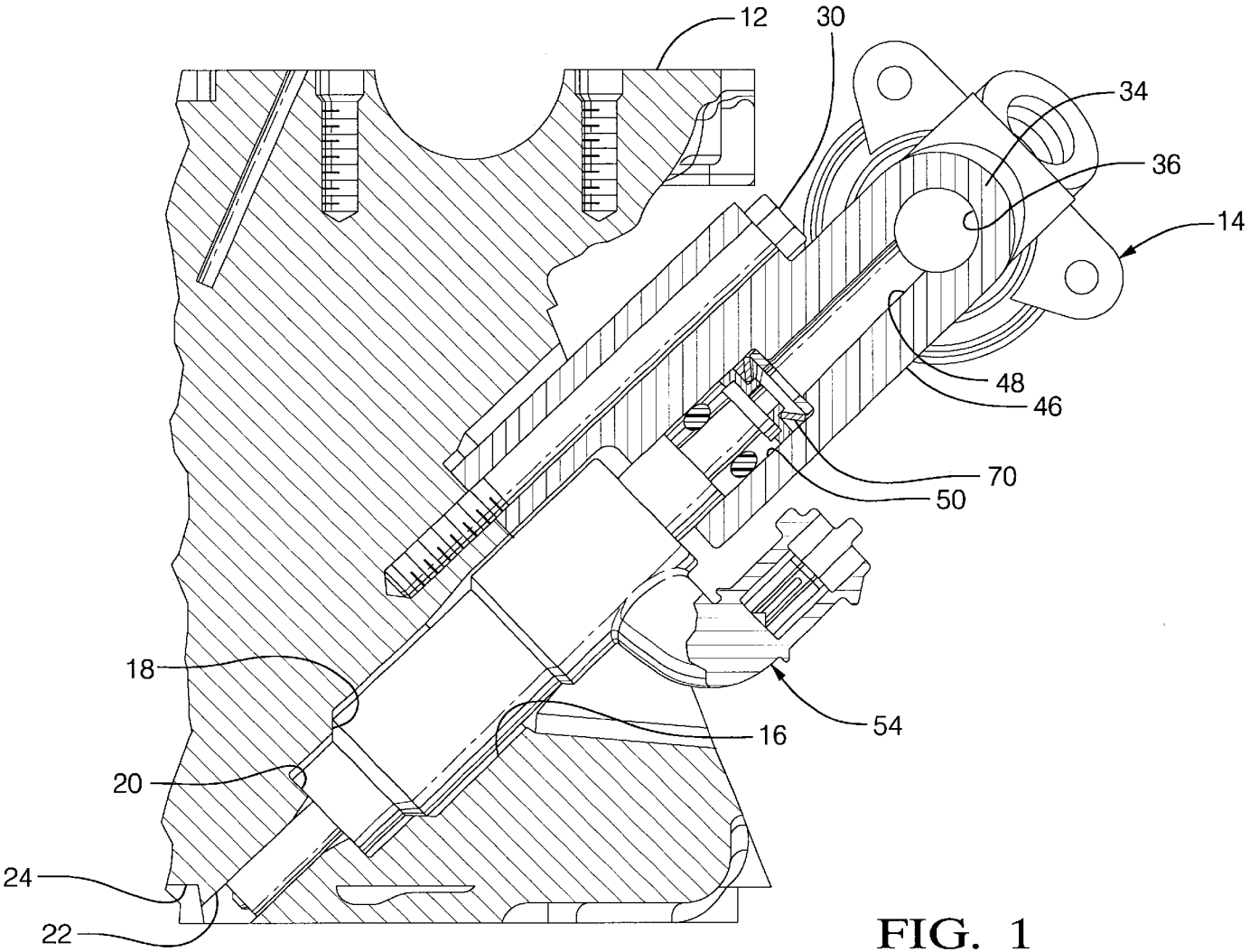
FIG. 1 is a fragmentary cross-sectional view through a portion of an engine assembly mounting of an integrated fuel delivery module of the prior art.

FIG. 1 is a cross-sectional view of a module type DI fuel delivery system disclosed in application Ser. No. 09/329,508. Cylinder head 12 includes a generally cylindrical injector mounting recess 16 for each cylinder of the engine. Recess 16 steps down to provide first and second injector seats 18 and 20, respectively. Recess 16 terminates in a smaller bore 22 that opens directly to an engine combustion chamber 24. A fuel module 14 includes a fuel rail 34 having a common fuel passage 36 extending longitudinally therein. At spaced locations (corresponding to the number and locations of the combustion chambers) along the length of the fuel rail 34, there is a plurality of laterally extending tubular portions 46. Tubular portion 46 defines a laterally extending feeder passage 48 connecting the common fuel passage 36 of fuel rail 34 with an injector mounting recess 50. Mounting recess 50 receives injector 54. Within each recess 50 is a spring 70 that loads injector 54 with an adequate force against one of injector seats 18 or 20 when module bolt 30 is tightened to secure fuel module 14 to cylinder head 12.

Figure 2:
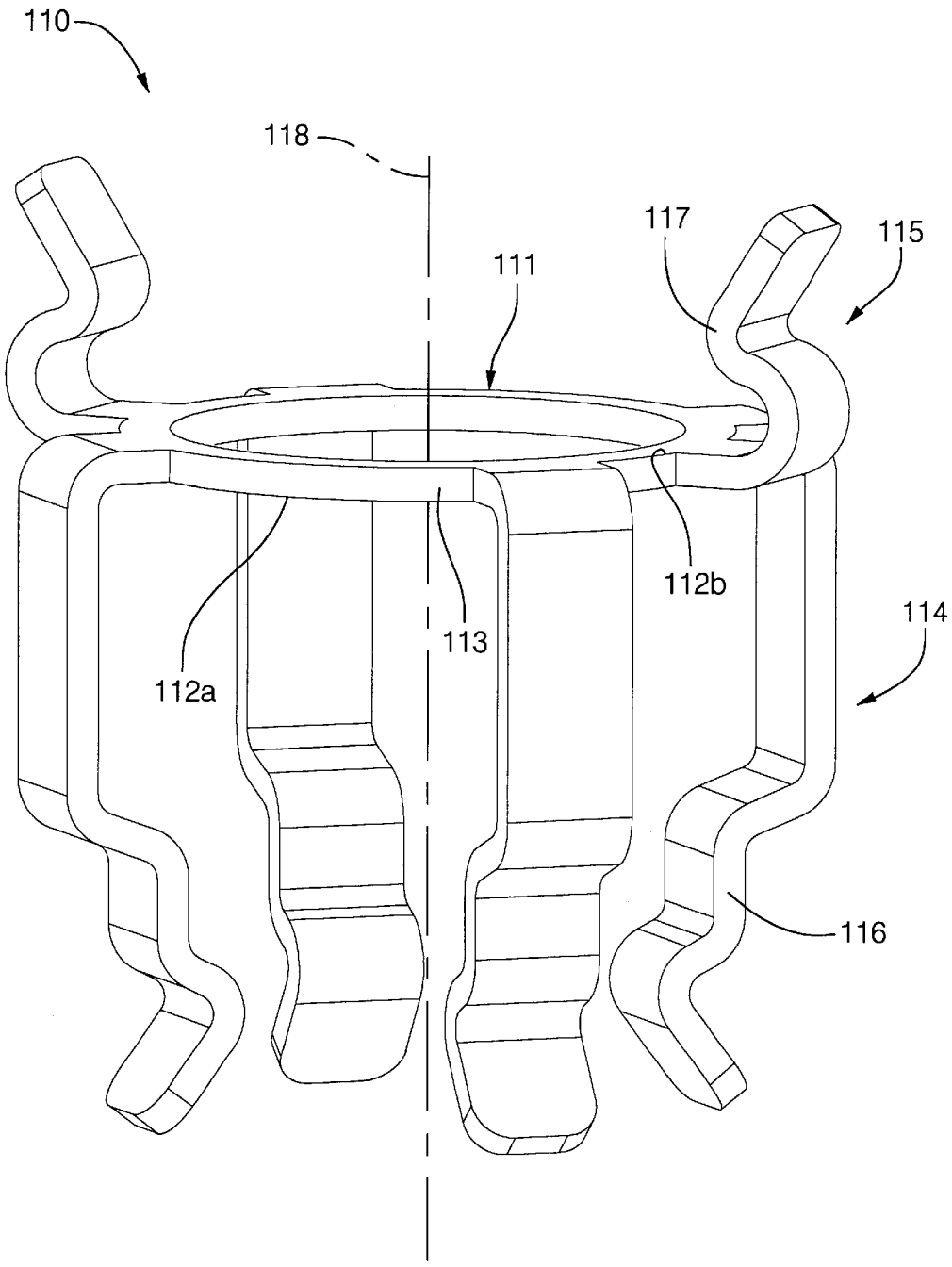
FIG. 2 is a perspective view of a spring clip included in a spring clip assembly of the present invention.
Figure 3:
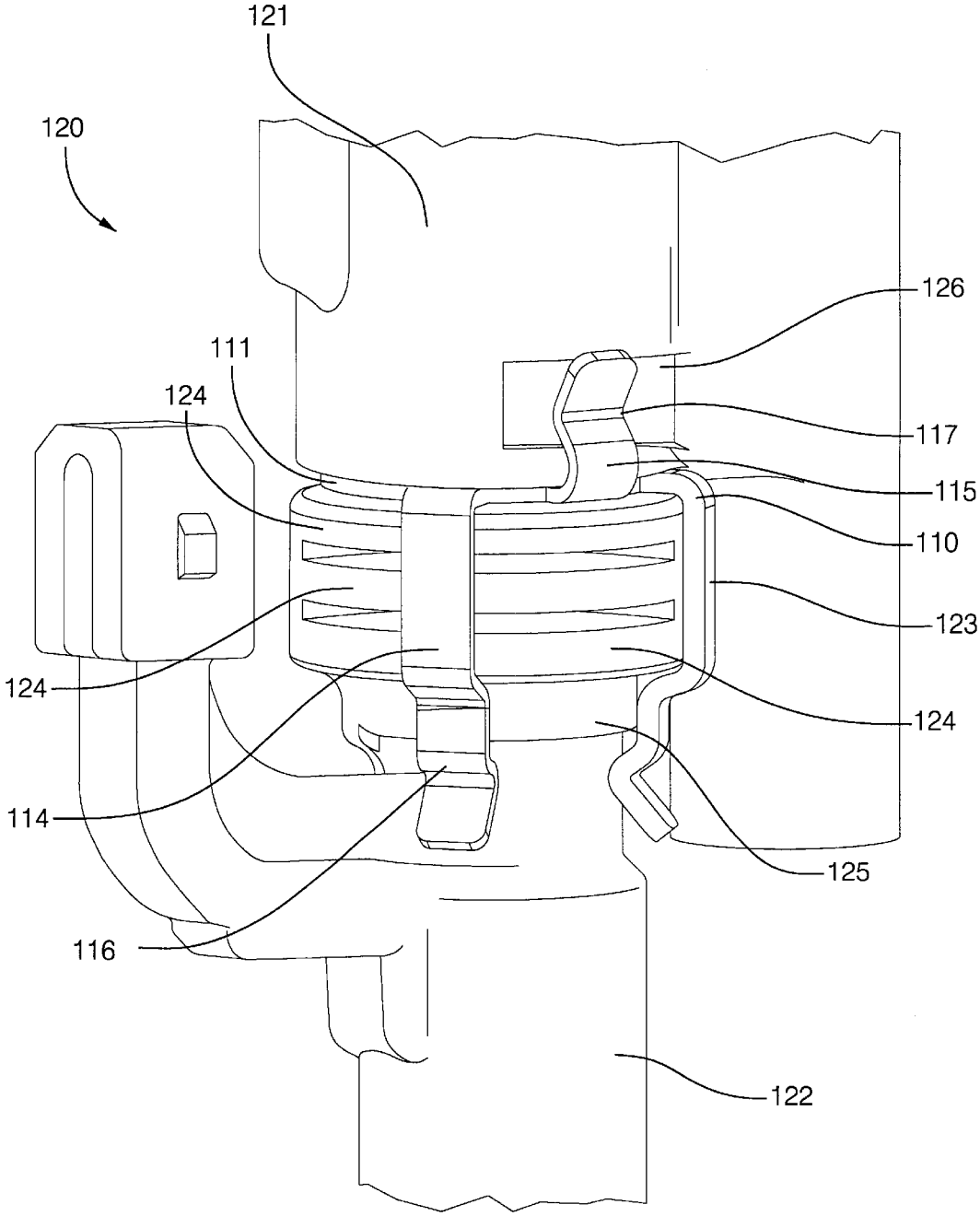
FIG. 3 is a perspective view of a portion of a fuel-rail injector assembly that includes the spring clip assembly of the present invention.

Referring now to FIGS. 2 and 3, there is shown a preferred embodiment of the present invention. Spring clip 110, is preferably formed as a unitary piece from spring steel and comprises a substantially circular ring 111 having surfaces 112*a* and 112*b* and a circumferential outer surface 113, to which is attached a first plurality of elongate fingers 114 and a second plurality of elongate fingers 115. First plurality of elongate fingers 114 extend in a first direction parallel to an axis 118 of ring 111. Axis 188 is aligned perpendicular to and at a center of ring 111. Each finger 114 has connecting means comprising an inwardly projecting reverse bend portion 116 for attaching ring 111 to a fuel injector 122, as shown in FIG. 3. As depicted in FIG. 2, each of reverse bend portions 116 includes two reverse bends. The second plurality of elongate fingers 115 extend in a second, in a second, opposite direction also parallel to the axis 118 of ring 111. Each finger 115 has connecting means comprising an inwardly projecting reverse bend portion 117 for attaching ring 111 to a fuel rail assembly 121, shown in FIG. 3.

Spring clip 110 preferably includes up to four separate elongate fingers 114 and up to four separate elongate fingers 115. As depicted in FIG. 2, spring clip 110 comprises four fingers 114 for attachment to the fuel injector 122 and two fingers 115 for attachment to the fuel rail.

FIG. 3 is a perspective view of a portion of a fuel rail-injector assembly 120, in accordance with the present invention. Assembly 120, shown in FIG. 3, includes a fuel rail assembly 121, and fuel injector 122, one of a plurality of injectors included in assembly 120. Also included in fuel rail-injector assembly 120 is a spring clip assembly 123 that comprises, in addition to spring clip 110, a spring means, shown in FIG. 3 as a plurality of disk springs 124.

As an alternative to disk springs 124, the spring means of spring clip assembly 123 may also comprise a helical coil compression spring (not shown) or any other appropriate structure to bias fuel injector 122 and fuel rail 121. As depicted in FIG. 3, springs 124 are radially contained within the structure provided by elongate fingers 114 and held axially proximate ring 111 by fingers 114, which are connected to fuel injector 122. If desired, however, elongate fingers 115, which are connected to fuel rail assembly 121, may be modified radially and axially to hold springs 124 proximate ring 111.

Fuel injector 122 is provided with a flange 125 or other similar member to engage reverse bend portions 116 of elongate fingers 114. Similarly, fuel rail 121 is provided with a plurality of flats 126 or other similar detent to engage reverse bend portions 117 of elongate fingers 115.

Fuel rail-injector assembly 120 is preferably pre-assembled and leak-tested prior to shipment and its subsequent convenient attachment as a unit to an engine cylinder head (not shown). When fuel rail-injector assembly 120 is bolted to the cylinder head, fuel injectors 122 are loaded against the injector seats 18, 20 in the cylinder head by spring means such as disk springs 124, which provide the force necessary to prevent injectors 122 from moving axially due to combustion pressures, vibration, and mechanical shock. Spring clip assembly 123 has sufficient travel and springs 124 have sufficient compressive stroke within fuel rail-injector assembly 120 to compensate for dimensional variation between injector seats 18, 20 and injector mounting surface 50. The pre-assembly of spring clip assembly 123, and, in turn, the pre-assembly of spring clip assembly 123 and injector 122 with fuel rail assembly 121 for all cylinders to form fuel rail—injector assembly 120 simplifies the assembly of the fuel rail and injectors to the cylinder head (not shown).

The invention has been described in detail with respect to a preferred embodiment for the purpose of illustration. It is to be understood that such detail is solely for that purpose, and variations can be made therein by those skilled in the art without departing from the spirit and scope of the invention, which is defined only by the following claims.

What is claimed is:

1. A spring clip assembly for connecting a fuel injector to a fuel rail in an internal combustion engine, said assembly comprising:

a substantially circular ring having a circumferential outer surface;

a first plurality and a second plurality of elongate fingers attached to said ring, said first plurality of elongate fingers extending in a first direction with respect to said ring and including connecting means for attaching said ring to said fuel injector, said second plurality of elongate fingers extending in a second, direction and including connecting means for attaching said ring to said fuel rail; and spring means held proximate a surface of said ring by one of said first plurality and second plurality of elongate fingers, said spring means providing a compressive load between said injector and said fuel rail.

2. The spring clip assembly of claim 1 wherein said spring means is held proximate said surface of said ring by said first plurality of elongate fingers.

3. The spring clip assembly of claim 1 wherein said connecting means for attaching said ring to said fuel injector comprises an inwardly projecting reverse bend portion on at least one elongate finger of said first plurality.

4. The spring clip assembly of claim 1 wherein said connecting means for attaching said ring to said fuel rail comprises an inwardly projecting reverse bend portion on at least one elongate finger of said second plurality.

5. The spring clip assembly of claim 1 wherein said spring means comprises at least one disk spring.

6. The spring clip assembly of claim 1 wherein said spring means comprises a plurality of disk springs.

7. The spring clip assembly of claim 1 wherein said spring means comprises a helical coil compression spring.

8. The spring clip assembly of claim 1 wherein said first and second pluralities of elongate fingers each comprises at least four elongate fingers.

9. The spring clip assembly of claim 8 wherein said first plurality of elongate fingers comprises four elongate fingers and said second plurality of elongate fingers comprises two elongate fingers.

10. The spring clip assembly of claim 9 wherein said first plurality of elongate fingers holds a plurality of disk springs proximate said surface of said ring.

11. The spring clip assembly of claim 1 wherein said ring and said elongate fingers are unitarily formed from spring steel.

12. A fuel rail-injector assembly for an internal combustion engine, said assembly comprising:

a fuel rail;

a fuel injector; and a spring clip assembly for connecting said injector to said rail, said spring clip assembly comprising:

a substantially circular ring;

a first plurality and a second plurality of elongate fingers attached to said ring, said first plurality of elongate fingers extending in a first direction with respect to said ring and including connecting means for attaching said ring to at least one of said plurality of fuel injectors, said second plurality of elongate fingers extending in a second direction and including connecting means for attaching said ring to said fuel rail; and spring means held proximate a surface of said ring by at least one of said first plurality and second plurality of elongate fingers, said spring means providing a compressive load between said injector and said rail.

13. The fuel rail-injector assembly of claim 12 wherein said spring means is held proximate said surface of said ring by said first plurality of elongate fingers.

14. The fuel rail-injector assembly of claim 12 wherein said connecting means for attaching said ring to said fuel injector comprises an inwardly projecting reverse bend portion on at least one of said first plurality of elongate fingers, and said connecting means for attaching said ring to said fuel rail comprises an inwardly projecting reverse bend portion on at least one of said second plurality of elongate fingers.

15. The fuel rail-injector assembly of claim 12 wherein said spring means comprises at least one disk spring.

16. The fuel rail-injector assembly of claim 12 wherein said spring means comprises a plurality of disk springs.

17. The fuel rail-injector assembly of claim 12 wherein said spring means comprises a helical coil compression spring.

18. The fuel rail-injector assembly of claim 12 wherein said first plurality of elongate fingers and said second plurality of elongate fingers each comprises at least four elongate fingers.

19. The fuel rail-injector assembly of claim 18 wherein said first plurality of elongate fingers holds a plurality of disk springs proximate said surface of said ring.

20. The fuel rail-injector assembly of claim 14 wherein at least one of said plurality of injectors comprises a flange for engaging said inwardly projecting reverse bend portions on at least one of said first plurality of elongate fingers.

21. The fuel rail-injector assembly of claim 13 wherein said fuel rail comprises at least one flat for engaging said inwardly projecting reverse bend portions on at least one of said second plurality of elongate fingers.

* * * * *